US005369824A

United States Patent [19]

Powell

[11] Patent Number: 5,369,824

[45] Date of Patent: Dec. 6, 1994

[54] MATERNITY MATTRESS

[76] Inventor: Bettye J. Powell, 2626 Long St., Chattanooga, Tenn. 37408

[21] Appl. No.: 131,390

[22] Filed: Oct. 5, 1993

[51] Int. Cl.[5] ..... A47C 27/00

[52] U.S. Cl. ..... 5/465; 5/930

[58] Field of Search ..... 5/465, 652, 657, 937, 5/930

[56] References Cited

U.S. PATENT DOCUMENTS

| | | | |
|---|---|---|---|
| 1,548,728 | 8/1925 | Milam . | |
| 2,089,854 | 8/1937 | Pellegrini | 5/930 |
| 3,118,152 | 1/1964 | Talley, Jr. . | |
| 3,378,862 | 4/1968 | Skinner . | |
| 3,451,071 | 6/1969 | Whiteley | 5/465 |
| 3,846,857 | 11/1974 | Weinstock | 5/465 |
| 3,967,335 | 7/1976 | Rhoads . | |
| 3,988,793 | 11/1976 | Abitbol | 5/930 |
| 4,021,872 | 5/1977 | Powell . | |
| 4,051,566 | 10/1977 | Esquivel . | |
| 4,054,960 | 10/1977 | Pettit | 5/930 |
| 4,596,384 | 1/1986 | Blosser | 5/465 |
| 4,819,287 | 4/1989 | Halverson . | |
| 5,185,897 | 2/1993 | Van Laanen . | |

*Primary Examiner*—Flemming Saether

*Attorney, Agent, or Firm*—Walker, McKenzie & Walker

[57] ABSTRACT

A reversible mattress for use by a pregnant woman. The mattress includes a planar first face having a cavity therein for accommodating the abdomen of the pregnant woman when the mattress is positioned with the first face facing upward and the pregnant woman lies prone upon the first face; and a planar second face having a cavity therein for accommodating the abdomen of the pregnant woman when the mattress is positioned with the second face facing upward and the pregnant woman lies prone upon the second face.

7 Claims, 1 Drawing Sheet

MATERNITY MATTRESS

BACKGROUND OF THE INVENTION

FIELD OF THE INVENTION

The present invention relates, in general, to mattresses for beds and is particularly directed towards an improved maternity mattress having provisions for accommodating the abdomen of a pregnant woman.

INFORMATION DISCLOSURE STATEMENT

Various maternity mattresses, pads and the like have been developed to receive the abdomen of a pregnant woman resting face down or prone on a bed so that maximum support can be provided by the bed with a minimum amount of discomfort, etc.

A preliminary patentability search in class 5, subclasses 462 and 930 produced the following patents which are believed to be relevant to the present invention:

Milam, U.S. Pat. No. 1,548,728, issued Aug. 4, 1925, discloses a mattress having a hingedly connected adjustable head support or pillow at one end thereof. The head support or pillow has an opening therethrough so that a person lying on his stomach can position his face over the opening for breathing purposes. The mattress has a removable section provided midway between the ends thereof so that, when removed, the space left can receive the abdomen of stout people.

Talley, U.S. Pat. No. 3,118,152, issued Jan. 21, 1964, discloses a pad that can be placed on a mattress or other sleeping surface for use by expectant mothers or other persons with enlarged abdomens to assist in sleeping or resting in a facedown position. The pad includes two symmetrical sections which, when put together, form a relative short, thick pad with a centrally disposed opening to receive an enlarged abdomen.

Skinner, U.S. Pat. No. 3,378,862, issued Apr. 23, 1968, discloses a maternity mattress provided with a cavity in its upper surface to accommodate the expanded abdomen of a woman in full term pregnancy. A stretchable panel extends across the top of the cavity and flexes into the cavity when a pregnant woman rests upon the mattress face down, the degree of flexure being dependent upon the size of the expanded abdomen. The panel thus serves as a continuing support for the expanded abdomen during the progressive stages of the pregnancy.

Rhoads, U.S. Pat. No. 3,967,335, issued Jul. 6, 1976, discloses a cushion or pillow of foam rubber having two circular holes cut therein to receive the mammary glands of a woman lying face down thereon.

Esquivel, U.S. Pat. No. 4,051,566, issued Oct. 4, 1977, discloses a mattress structure with a modifiable cavity extending therethrough for accommodating the expandable abdomen of a woman during a full term pregnancy. An insert is movably mounted in the cavity such that the bed may have its normal plane surface configuration or a modified cavity in its surface such that a woman resting upon the mattress face down can rest her abdomen in the cavity and have it sized such that the periphery of the cavity serves as a contacting support for the expanding abdomen during the progressive stages of pregnancy.

Halverson, U.S. Pat. No. 4,819,287, issued Apr. 11, 1989, discloses a mattress for pregnant women which has a main mattress section with an opening therein for serial cushions for abdominal support. A plurality of cushions are serially arranged within one another and are located within the opening of the main mattress section. At least one of the cushions is non-inflatable to enhance structural support. At least some of the cushions preferably have a height which is in excess of the height of the main mattress section.

Van Laanen, U.S. Pat. No. 5,185,897, issued Feb. 16, 1993, discloses an inflatable maternity mattress. The mattress is provided with a central, generally cylindrical cavity which extends through the thickness of the mattress. The lower end of the cavity is enclosed by a bottom panel, while a top panel is located within the cavity and the peripheral edge of the top panel is sealed to the upper surface of the mattress bordering the cavity. The central portion of the top panel is secured to the bottom panel. A gas, such as air, can be supplied to the chamber between the panels to thereby inflate the upper panel and adjust the depth of the cavity to accommodate the abdomen of a pregnant woman.

Additionally, the inventor knows of Powell, U.S. Pat. No. 4,021,872, issued May 10, 1977, which discloses a maternity mattress having a cavity for accommodating the abdomen of a pregnant woman as she lies upon the mattress in a pron position. The mattress tick includes a removable portion which normally lies conterminously above the cavity to readily expose the cavity. A plurality of resilient disklike members are included and jointly conform in size and shape with the cavity to normally fill the cavity. The disklike members can be removed one at a time as the pregnancy progresses thus enabling the size of the cavity to be gradually increased commensurate with the expanding abdomen of the woman.

None of the above identified patents disclose or suggest the present invention. More specifically, nothing in the known prior art is believed to disclose or suggest a reversible mattress including a planar first face having a cavity therein for accommodating a pregnant woman's abdomen as she lies upon the first face of the mattress in a prone position, and including a planar second face having a cavity therein for accommodating a pregnant woman's abdomen as she lies upon the second face of the mattress in a prone position.

SUMMARY OF THE INVENTION

The present invention is directed toward providing an improved maternity mattress. A basic concept of the present invention is to design a maternity mattress in such a way that it can be reversed to accommodate different size abdomens.

The reversible mattress of the present invention includes, in general, a planar first face having a cavity therein for accommodating a pregnant woman's abdomen as she lies upon the first face of the mattress in a prone position, and including a planar second face having a cavity therein for accommodating a pregnant woman's abdomen as she lies upon the second face of the mattress in a prone position.

DESCRIPTION OF THE PREFERRED EMBODIMENTS

A first preferred embodiment of the reversible mattress of the present invention is shown in FIGS. 1, 2, 4 and 5 of the drawings, and identified by the numeral 11.

The reversible mattress 11 is especially designed for use by a pregnant woman W. The mattress 11 may include a substantially rectangular foam rubber block or body 13. However, the body 13 of the mattress 11 can be made out of various other materials as will now be apparent to those skilled in the art such as, for example, cotton ticking, etc. The size of the body 13 of the mattress 11 is preferably that of a normal mattress, but may also vary as will now be apparent to those skilled in the art. The size of the body 13 of the mattress 11 is preferably at least that of a standard full or double size mattress, but may also be that of a larger queen or king size mattress, etc.

Figure 5:
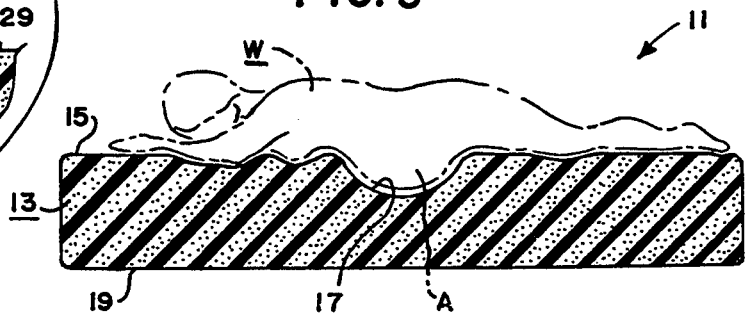
FIG. 5 is a sectional view substantially as taken on line 5—5 of FIG. 1 with a woman shown resting thereon in broken lines and with portions thereof omitted for clarity.

The mattress 11 includes a planar or substantially planar first side or face 15 having a cavity 17 therein for accommodating the abdomen A of the pregnant woman W when the mattress 11 is positioned with the first face 15 facing upward and the pregnant woman W lies prone upon the first face 15 as clearly shown in FIG. 5.

The mattress 11 includes a planar or substantially planar second side or face 19 having a cavity 21 therein for accommodating the abdomen A of the pregnant woman W when the mattress 11 is positioned with the second face 19 facing upward and the pregnant woman W lies prone upon the second face 19 as will now be apparent to those skilled in the art.

Figure 1:
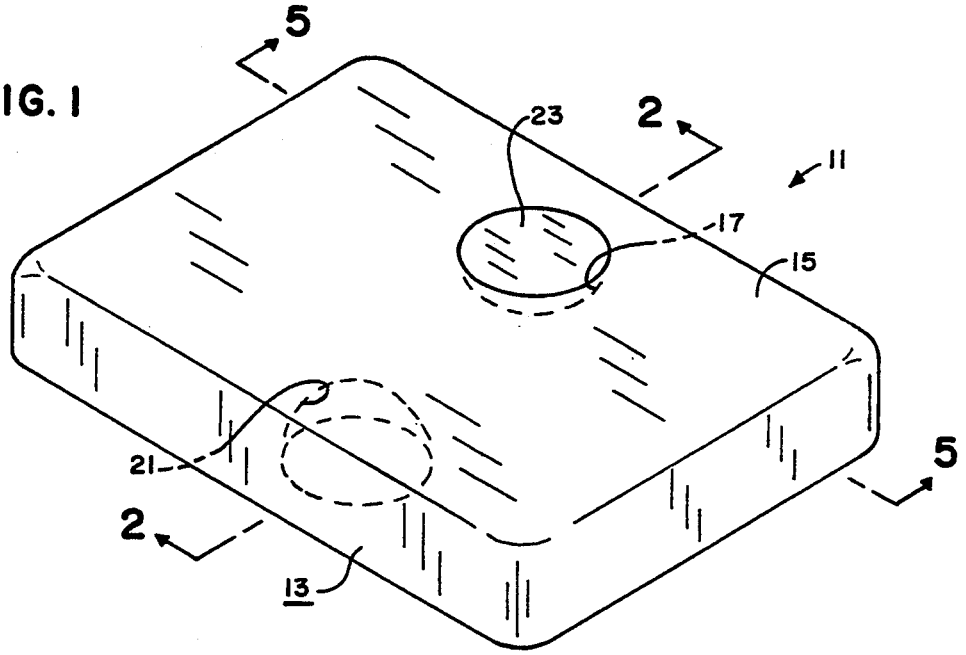
FIG. 1 is a perspective view of a first embodiment of the reversible mattress of the present invention.
Figure 2:
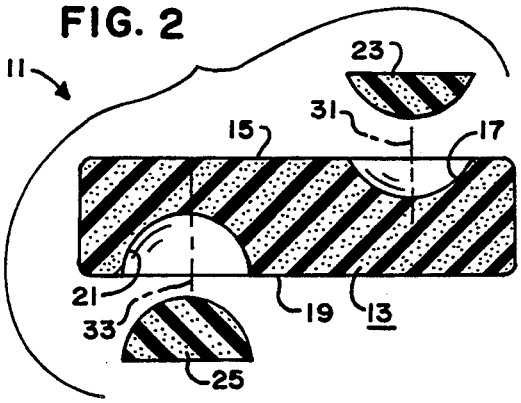
FIG. 2 is a sectional view substantially as taken on line 2—2 of FIG. 1 with portions thereof in a moved position and with other portions thereof omitted for clarity.

The cavity 21 in the second face 19 of the mattress 11 is preferably larger in diameter and depth than the cavity 17 in the first face 15 of the mattress 11 as is clearly shown in FIG. 2. The larger size cavity 21 will thus accommodate a larger abdomen A. Accordingly, the mattress 11 is normally positioned with the first face 15 facing upward during the early stages of pregnancy (e.g., through the second trimester) and is reversed so that the second face 19 faces upward during the late stages of pregnancy (e.g., during the third trimester) as will now be apparent to those skilled in the art.

The mattress 11 preferably includes a first pillow 23 for selectively filling the cavity 17 in the first face 15 thereof and a second pillow 25 for selectively filling the cavity 21 in the second face 19 when the mattress 11 is not being used to accommodate a pregnant woman W, etc. Thus, with the pillows 23, 25 filling the respective cavities 17, 21, the first and second faces 15, 19 of the mattress 11 will be fully planar for use as a standard, non-maternity mattress. The mattress 11 may include securing means for removably securing the pillows 23, 25 in place on the mattress 11. The securing means may consist of coacting fasteners with a first fastener member 27 attached to a respective pillow 23, 25 (see, for example, the pillow 23 in FIG. 4) and with a coacting second fastener member 29 attached to the mattress 11 adjacent a respective cavity 17, 21 (see, for example, the cavity 17 in FIG. 4) so that the first and second fastener members 27, 29 will coact with one another when brought into contact with one another as will now be apparent to those skilled in the art. The fastener members 27, 29 may consist of typical Velcro ® brand hook-and-loop type fastener members as will now be apparent to those skilled in the art.

As clearly shown in FIG. 2, the vertical axis 31 of the cavity 17 in the first side 15 is preferably offset or displaced from the vertical axis 33 of the cavity 21 in the second face 19. Thus, when viewed in plan, the cavities 17, 21 are substantially side-by-side. Accordingly, with the mattress 11 sized as a full or double size mattress (or larger), the cavity 17 is located on what would normally be one side of the mattress 11 while the cavity 21 is located on what would normally be the other side of the mattress 11.

Figure 3:
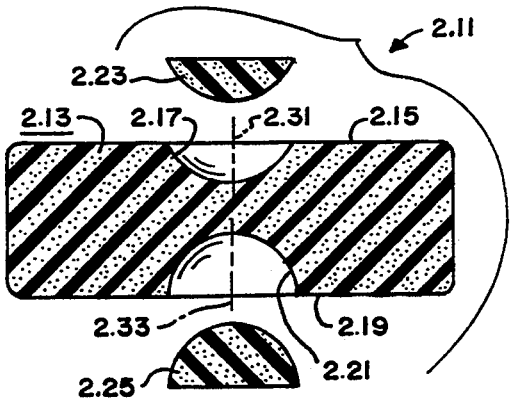
FIG. 3 is a sectional view substantially similar to FIG. 2 but showing a second embodiment of the reversible mattress of the present invention.
Figure 4:
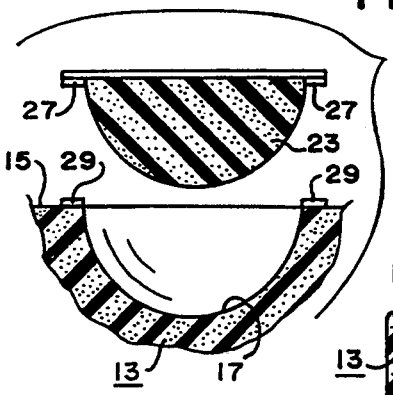
FIG. 4 is an enlarged view of a portion of FIG. 2, showing additional details of the reversible mattress of the present invention.

A second preferred embodiment of the reversible mattress of the present invention is shown in FIG. 3 of the drawings, and identified by the numeral 2.11.

The reversible mattress 2.11 is similar to the mattress 11 and may include a substantially rectangular foam rubber block or body 2.13, a planar or substantially planar first side or face 2.15 having a cavity 2.17 therein for accommodating the abdomen A of the pregnant woman W when the mattress 2.11 is positioned with the first face 2.15 facing upward and the pregnant woman W lies prone upon the first face 2.15, a planar or substantially planar second side or face 2.19 having a cavity 2.21 therein for accommodating the abdomen A of the pregnant woman W when the mattress 2.11 is positioned with the second face 2.19 facing upward and the pregnant woman W lies prone upon the second face 2.19, a first pillow 2.23 for selectively filling the cavity 2.17 in the first face 2.15 thereof, and a second pillow 2.25 for selectively filling the cavity 2.21 in the second face 2.19 when the mattress 2.11 is not being used to accommodate a pregnant woman W, etc. The mattress 2.11 may also include securing means (not shown) for removably securing the pillows 2.23, 2.25 in place on the mattress 11. The securing means of the mattress 2.11 may be identical to the securing means disclosed hereinabove relative to the mattress 11. The cavity 2.21 in the second face 2.19 of the mattress 2.11 is preferably larger in diameter and depth than the cavity 2.17 in the first face 2.15 of the mattress 2.11 as is clearly shown in FIG. 3 for the same reasons as hereinabove disclosed relative to the cavities 17, 21 of the mattress 11. However, as opposed to the mattress 11 and as clearly shown in FIG. 3, the vertical axis 2.31 of the cavity 2.17 in the first side 2.15 of the mattress 2.11 is preferably aligned with the vertical axis 2.33 of the cavity 2.21 in the second face 2.19. Thus, when viewed in plan, the cavities 2.17, 2.21 are substantially one above the other. Accordingly, with the mattress 11 sized as a twin or single double size mattress, the cavities 2.17, 2.21 are located on what would normally be the center of the mattress 2.11. Also, it should be noted that with the cavities 2.17, 2.21 aligned one above the other, the body 2.13 of the mattress 2.11 is preferably almost twice the thickness of the body 13 of the mattress 11.

Although the present invention has been described and illustrated with respect to a preferred embodiment and a preferred use therefor, it is not to be so limited since modifications and changes can be made therein which are within the full intended scope of the invention.

I claim:

1. A reversible mattress for supporting substantially the entirety of a pregnant woman, said mattress being a unitary, full sized body, having a first side and a second side, said body including:

(a) a planar first face forming the entire second side of said body and, having a cavity therein for accommodating the abdomen of the pregnant woman when the mattress is positioned with said first face facing upward and the pregnant woman lies prone upon said first face; said cavity in said first face having an opened first end for receiving the abdomen of the pregnant woman and having a closed second end; and (b) a planar second face having a cavity therein for accommodating the abdomen of the pregnant woman when said mattress is positioned with said second face facing upward and the pregnant woman lies prone upon said second face; said cavity in said second face having an opened first end for receiving the abdomen of the pregnant woman and having a closed second end.

2. The mattress of claim 1 in which said cavity in said first face is circular in plane; in which said cavity in said second face is circular in plane; and in which said cavity in said second face thereof is larger in diameter and depth than said cavity in said first face thereof.

3. The mattress of claim 2 in which is included a first pillow for selectively filling said cavity in said first face and a second pillow for selectively filling said cavity in said second face.

4. The mattress of claim 2 in which said cavity in said first face has a vertical axis; in which said cavity in said second face has a vertical axis; and in which said vertical axes of said cavities in said first and second faces are aligned with one another.

5. The mattress of claim 2 in which said cavity in said first face has a vertical axis; in which said cavity in said second face has a vertical axis; and in which said vertical axes of said cavities in said first and second faces are displaced from one another.

6. A reversible mattress for supporting substantially the entirety of a pregnant woman, said mattress comprising:

(a) a unitary, full sized body having a first side and a second side, said body including:

(i) a planar first face forming the entire first side of said body and; having a cavity therein for accommodating the abdomen of the pregnant woman when said mattress is positioned with said first face facing upward and the pregnant woman lies prone upon said first face; said cavity in said first face having an opened first end for receiving the abdomen of the pregnant woman and having a closed second end; said cavity in said first face is circular in plane and has a vertical axis;

ii a planar second face forming the entire second side of said body and having a cavity therein for accommodating the abdomen of the pregnant woman when said mattress is positioned with said second face facing upward and the pregnant woman lies prone upon said second face; said cavity in said second face having an opened first end for receiving the abdomen of the pregnant woman and having a closed second end; said cavity in said second face is circular in plane and has a vertical axis; said cavity in said second face thereof is larger in diameter and depth than said cavity in said first face thereof; said vertical axes of said cavities in said first and second faces are aligned with one another;

(b) a first pillow for selectively filling said cavity in said first face; and (c) a second pillow for selectively filling said cavity in said second face.

7. A reversible mattress for supporting substantially the entirety of a pregnant woman, said mattress comprising:

(a) a unitary, full sized body including:

(i) a planar first face forming the entire first side of said body and having a cavity therein for accommodating the abdomen of the pregnant woman when said mattress is positioned with said first face facing upward and the pregnant woman lies prone upon said first face; said cavity in said first face having an opened first end for receiving the abdomen of the pregnant woman and having a closed second end; said cavity in said first face is circular in plane and has a vertical axis; and (ii) a planar second face forming the entire second side of said body and having a cavity therein for accommodating the abdomen of the pregnant woman when said mattress is positioned with said second face facing upward and the pregnant woman lies prone upon said second face; said cavity in said second face having an opened first end for receiving the abdomen of the pregnant woman and having a closed second end; said cavity in said second face is circular in plane and has a vertical axis; said cavity in said second face thereof is larger in diameter and depth than said cavity in said first face thereof; said vertical axes of said cavities in said first and second faces are displaced from one another;

(b) a first pillow for selectively filling said cavity in said first face; and (c) a second pillow for selectively filling said cavity in said second face.

* * * * *